United States Patent [19]

Carbone

[11] 4,061,067

[45] Dec. 6, 1977

[54] MODIFIED PIANO STRIKING MECHANISM

[76] Inventor: Jorge L. Carbone, 1544 Gottschall Road, Stow, Ohio 44224

[21] Appl. No.: 581,026

[22] Filed: May 27, 1975

[51] Int. Cl.[2] ..... G10C 3/18

[52] U.S. Cl. ..... 84/236; 84/237; 84/240; 84/243; 84/221

[58] Field of Search ..... 84/236, 237, 238, 239, 84/240, 241, 242, 243, 221

[56] References Cited

U.S. PATENT DOCUMENTS

| | | | |
|---|---|---|---|
| 515,279 | 2/1894 | Brown | 84/243 |
| 2,881,509 | 4/1959 | Gadebusch | 84/236 |
| 2,958,249 | 11/1960 | Machalek et al. | 84/237 |
| 3,151,516 | 10/1964 | Bernstein | 84/240 |
| 3,319,503 | 5/1967 | Corey | 84/240 |
| 3,583,271 | 6/1971 | Corwin et al. | 84/236 |
| 3,651,732 | 3/1972 | Erbert et al. | 84/240 |
| 3,757,026 | 9/1973 | Carbone | 84/236 |

*Primary Examiner*—Stephen J. Tomsky
*Attorney, Agent, or Firm*—Hamilton, Renner & Kenner

[57] ABSTRACT

Disclosed is a modified striking mechanism for use in pianos and related instruments having strings or their equivalent to produce musical notes and keys to select the notes. The mechanism includes a hammer assembly, a lever driving the hammer, coacting gear means for imparting motion to the hammer and features a novel escapement action for use therewith. Additionally disclosed are improvements including an escapement action adapted for use with conventional piano striking mechanisms, a novel damper assembly, a mechanism for activation by the soft pedal of the piano, a tension adjustment mechanism for varying the amount of force necessary to strike a key, and novel balance rail and capstan lever assemblies.

19 Claims, 11 Drawing Figures

MODIFIED PIANO STRIKING MECHANISM

BACKGROUND OF THE INVENTION

The present invention is directed toward improvements in the striking mechanism of the piano and related instruments wherein a mechanism is provided for a string or other sound producing member to be struck in response to depression of a key.

The striking mechanisms that are presently used in pianos may be characterized as a movement which enables the pianist to put expression into the music being played and which can provide many years of use without malfunction. Although the mechanisms are somewhat varied as to complexity, the piano's history extends to the early part of the eighteenth century from which it evolved until approximately the first quarter of the nineteeth century into a design which has remained basically unchanged to the present time.

It was the desire of the early piano makers to afford the pianist control over the duration of his notes. Thus, a hammer was needed which would strike the string and immediately fall away even while the key remained depressed. Upon release of the key, simultaneous application of a damper to the vibrating string must be had in order to terminate the particular note. To facilitate striking of the strings, a more difficult task than damping, two mechanisms evolved as the piano began to develop.

One of these, the jack mechanism, involved a lever, or jack, which was mounted beyond the pivot point of the key. Immediately above the head of the jack was the shank of the hammer. The shank was generally mounted by a hinge behind the point of contact of the jack, and the hammer itself was carried at the opposite end of the shank of the jack. Depression of the key raised its extremity and the jack which imparted impetus to the hammer, throwing it against the string. Simultaneous with its movement the jack also raised the damper from the string to permit vibration. The hammer, having struck the string, fell away to rest upon the raised jack. Subsequent release of the key, brought the jack away from the hammer and permitted the damper to repose against the string.

This system had its disadvantages, however. The hammer had to be positioned at some distance from the string so that it could not bounce off of the jack to strike the string a second time, and to prevent the jack from breaking the shank. This required the keys to be struck firmly and a short period of time for the hammer to return to its place making a soft touch and rapid repetition of a note impossible.

The second mechanism, known as the double escapement system, remedied both of the disadvantages inherent with the jack mechanism. The escapement system is characterized by a lever which throws the hammer against the string as did the jack, but unlike the latter, the lever slips away or escapes from the hammer after moving it and is thereafter free from control by the key.

Perhaps the only disadvantage of the double escapement mechanism is in the number of components necessary to produce each note which varies from about 50 to more than 80, depending upon manufacturers. It is understandable that large expenditures of labor are necessary to manufacture the components and assemble the striking mechanisms, greatly adding to the cost of the instrument. Despite rising costs of labor and the necessary materials, little if any attention has been devoted toward simplification of the mechanism.

One such design which greatly decreased the number of components for a striking mechanism has been described in my earlier U.S. Pat. No. 3,757,026. Although the former mechanism could readily be manufactured and substituted for existing units in a piano, it was believed that an escapement action was not necessary inasmuch as a fair rapidity of repetition was afforded the pianist for all notes without sacrifice of expression. It is now believed that a suitable escapement action would be desirable as well as several other improvements which should benefit the pianist as well as the manufacturer.

SUMMARY OF THE INVENTION

It is therefore an object of the present invention to provide a novel escapement action for a simplified striking mechanism.

It is another object of the present invention to provide a novel escapement action which can readily be employed with conventional striking mechanisms to eliminate several of the components heretofore necessary.

It is yet another object of the present invention to provide a novel striking mechanism having an adjustment readily accessible to the pianist whereby the amount of force required to depress a key to produce a note can be varied.

It is still another object of the present invention to provide a novel damper mechanism for the strings of instruments such as pianos.

It is a still further object of the present invention to provide a novel striking key having an improved balance rail assembly and capstan lever assembly to simplify construction of the mechanism and permit the size of the overall striking mechanism to be reduced.

It is yet another object of the present invention to provide various improvements to piano striking mechanisms which utilize components requiring less labor for manufacture and construction and which may be formed from cheaper materials; which are relatively maintenance free; and, which are not adversely affected by atmospheric conditions.

In general the striking mechanism of the present invention may be employed in pianos and related instruments having at least one string to produce a musical note and at least one key to select the note and includes a hammer assembly for striking the string, an escapement action actuated by the key and a first lever which is engageable with the escapement action and hammer assembly. Coacting gear means are included for imparting motion to the hammer assembly by the first lever and means are provided for supporting the various components.

In addition to the modified piano striking mechanism, a novel embodiment for a simplified escapement action is disclosed which has been designed for use with conventional piano striking mechanisms, the advantage being the ability to reduce the complexity and number of parts of the conventional double escapement mechanism while maintaining other standard components of the conventional piano. The novel escapement action may be selected during the manufacture of the piano or as a replacement for worn or damaged components of the double escapement mechanism.

Additional improvements include a novel damper assembly; a novel mechanism for activation by the soft pedal of the piano, unlike existing systems which shift the entire striking mechanism laterally with respect to the strings; a tension adjustment mechanism for varying the amount of force necessary to strike a key; and, novel balance rail and capstan lever assemblies.

In the descriptions which follow of the preferred embodiments, the term striking mechanism shall be employed interchangeably to refer to a single mechanism for activation by a single key or the total mechanism activated by a conventional keyboard having 88 keys or, a mechanism including the keys. Similarly, when reference is made to a string, a piano wire is intended, it being further understood that, as the number of strings per note will vary per note, i.e., one string in the lower octaves and three in the mid and upper octaves, use of the word string should not suggest that only one string per note is required. The improvements disclosed herein have all been adapted for use within the framework and exterior furniture, or piano case, and the harp and strings carried therein. Several of the improvements could also be employed in similar instruments which would utilize movable keys and a string, or their equivalent, to produce musical notes.

The preferred embodiments of the subject invention are shown by way of example in the accompanying drawings and descriptions, without attempting to show all of the various forms and modifications within the concept of the present invention; the invention being measured by the appended claims and not by the details of the specification.

DESCRIPTION OF THE PREFERRED EMBODIMENTS

Figure 1:
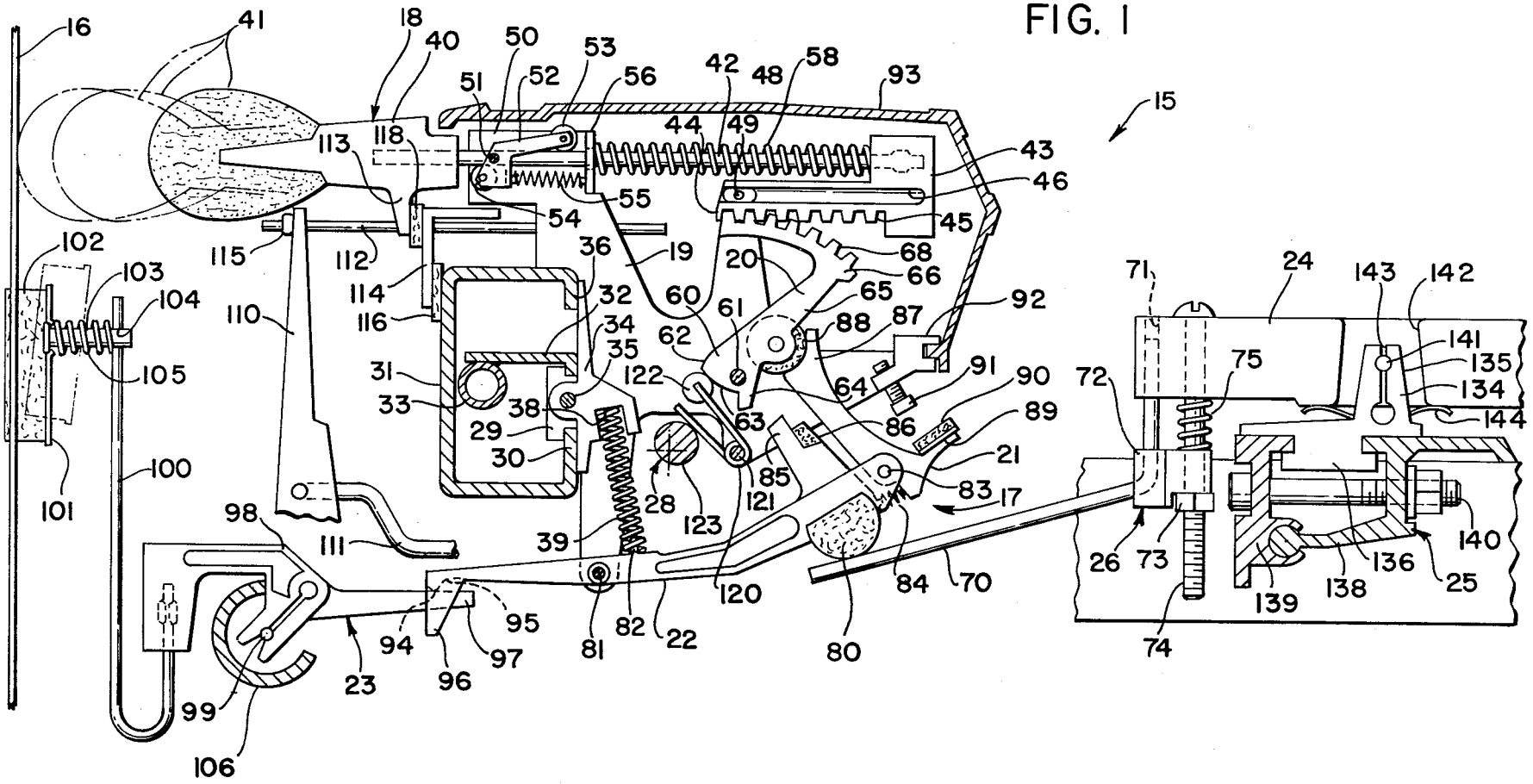
FIG. 1 is a side elevation, partially in section, of a striking mechanism for use in an upright piano, depicting several new improvements.

A striking mechanism embodying the features of the present invention is indicated generally by the numeral 15, in FIG. 1. Inasmuch as each individual mechanism will be alike for all keys, only a single mechanism 15 is depicted. The mechanism 15 is intended for an upright piano the strings 16 of which generally lie in a vertical plane. The mechanism includes an escapement action indicated generally by the numeral 17 a hammer assembly, indicated generally by the numeral 18, which is carried by a support plate 19. A drive link 20, also carried by plate 19, engages a portion of the hammer assembly 18 and a movable jack 21. The jack 21 is pivotally connected to one end of an action arm 22 which is itself pivotally carried by plate 19. The opposite end of the action arm 22 communicates with and operates a damper assembly, indicated generally by the numeral 23. Movement of the hammer assembly 18 is activated by depression of a key 24, The improved balance rail assembly and capstan lever assembly are also depicted in FIG. 1 and are indicated generally by the numerals 25 and 26, respectively. Lastly, a portion of the tension adjustment mechanism, generally 28, is depicted in engagement with the drive link 20.

The support plate 19, to which most of the moving components are affixed may be readily manufactured from a suitable plastic or nylon and each of the individual moving components, i.e., hammer assembly 18, drive link 20, jack 21 and lever 22 are held between two plates 19, there being 89 such plates 19 for an 88 note keyboard. Each plate 19 is provided with a twin channeled frontal flange 29, the lower channel of which engages the tip of the lower wall 30 of a C-shaped frame member 31. A hinge rail 32 engages the upper channel of flange 29, securing it and the remainder of plate 19 to the frame. The hinge rail 32 is itself welded to a bar 33, which when rotated counterclockwise, as depicted in FIG. 1, will permit removal and/or mounting of plate 19. Frame member 31 and bar 33 may be connected to support brackets (not shown) at both ends to permit mounting of the total striking mechanism in the piano. The plates 19 are more securely held in the frame 31 by a brace member 34, affixed to each plate via an integral lug 35, and which butts against the rear face of lower wall 30 and upper wall 36 of frame member 31. An indentation 38 is provided in brace member 34 for receipt of a compression spring 39.

The hammer assembly 18 includes a head 40, having a conventional felt covering 41. The head 40 is carried by a longitudinally extending rod 42 which carries at its other end the hammer butt 43 which is preferably manufactured of plastic. The butt 43 has a leg 44 which extends under a portion of the rod 42 and carries a rack of teeth 45. To facilitate mounting of the butt 43, it may be formed with laterally extending channels 46, parallel with rod 42. A small shoe 48 carried by a lug 49 from plate 19 engages the channel 46 and permits reciprocal movement of the butt 43 and head 40 toward and away from the string 16.

At the forward upper end 50 of plate 19 a lug 51 mounts a roller bracket 52. The roller bracket 52 has opposed sides which are separated by upper and lower rollers, 53 and 54, respectively, which engage the hammer rod 42 to guide its movement with a minimum of friction. A compression spring 55 is held between a lug on roller bracket 52 and a lug on flange 56 extending from plate 19. As depicted in FIG. 1, the roller bracket 52 is rotatably biased, clockwise, against the hammer rod 42 in order to retain rollers 53 and 54 in engagement therewith. A bore in flange 56 permits passage of rod 42 therethrough and a compression spring 58, positioned around the rod 42 and between the flange 56 and butt 43, resiliently biases the hammer head 40 away from the string 16, to the solid line position in FIG. 1.

The drive link 20, also manufactured from plastic or other suitable material, is mounted near its base 60 on a lug 61 extending from the plate 19. The forward edge of the base is formed by the juncture of an upper cam surface 62 with a lower cam surface 63. A tang 64 projects rearwardly from the base 60 while an elongate arm 65 extends in the opposite direction. At the end of the arm 65 is an arcuate drive sector 66, having a plurality of teeth 68. The drive sector 66 has a shape defined by the arc of a circle centered at the lug 61. Counterclockwise rotation of the drive link 20 advances the hammer butt 43 and head 40 toward the string 16 by meshing of the rack teeth 45 with the drive sector teeth 68.

In order to impart rotational movement to the drive link 20 the key 24 is depressed which raises the capstan lever assembly 26. The assembly 26 includes a lever arm 70, itself comprising a shaped steel rod or other suitable metal, one end of which is received within a bore 71 near the end of the key 24. The neck or bent portion of lever arm 70 is carried by a collar 72 which is itself supported by a nut 73 on an adjustment screw 74 which passes through the key 24. A compression spring 75 encircles the screw 74 and is interposed between the bottom of key 24 and the top of collar 72. As should be evident, turning the screw 74 will effectively raise or lower the lever arm 70 in bore 71. As should also be apparent, the design of the assembly 26 permits the striking mechanism 15 to be partially disposed lower than the upper surface of the keys 24, thereby facilitating compactness of the furniture portion of the piano.

The forwardmost end of the lever arm 70 engages a felt pad 80 provided near the jack end of arm 22. The arm 22, pivotally affixed to a lug 81 from plate 19, has a lug 82 which mounts one end of compression spring 39 which in turn biases the arm 22 downwardly against the lever arm 70. The jack 21 is pivotally affixed to the jack end of arm 22 with a suitable pin 83 and, a small compression spring 84, held between opposed lugs on arm 22 and jack 21, tends to pivot the jack 21 in a counterclockwise direction around the pin 83.

On the upper side of arm 22, generally opposite the felt pad 80 is a leg 85 which communicates with the tang 64 as the arm 22 is raised by depression of a key 24. A small felt cushion 86 may be provided along the leg 85, as depicted in FIG. 1 the purpose of which shall be explained with reference to FIG. 3. The jack 21 extends generally upwardly away from the pin 83 and terminates in an arcuate foot 87 which engages a round felt cushion 88 carried by the drive link 20 and by which the link is rotated. At the lower end of jack 21 is a perpendicularly extending foot 89 having a felt pad 90 which is brought into silent contact with an adjustable stop screw 91 threadably engaging a molded end 92 carried by support plate 19. A removable dust cover 93 may be provided and is secured in end 92.

At the end opposite the jack end the action arm 22 has a downwardly extending foot 94 which carries a channel 95 forming a yoke 96 in the foot 94. The tip 97 of a damper lever 98 is received within the yoke 96. The lever 98, which may be formed from a suitable plastic material, is pivotally affixed to a round bar 99 which traverses the width of the entire striking mechanism 15. A damper wire 100, formed from spring steel has one end embedded in the damper lever 96 while the other end extends upwardly, in general alignment with the strings 16. A damper head 101 is provided with a felt pad 102, to engage a string or strings 16, and with a rearwardly extending rod 103 which itself has an aperture 104 through which the damper wire 100 may pass. A fairly strong compression spring 105 encircles the rod 103 between the head 101 and wire 100 to maintain the damper head 101 and pad 102 in position against the strings 16 and to facilitate removal from the wire 100.

Depression of a key 24 causes the tip 97 of damper lever 98 to rotate downwardly about lug 81, which in turn pivots the lever 98 clockwise about rod 99 to withdraw the head 101 away from the string 16 to the position depicted in phantom. In order to withdraw all damper heads 101 from the strings simultaneously, rotatable channel member 106 may be provided. The channel member 106, when connected to suitable linkage, not shown, will pivot clockwise around rod 99, when activated, to rotate all damper levers 98.

Figure 2:
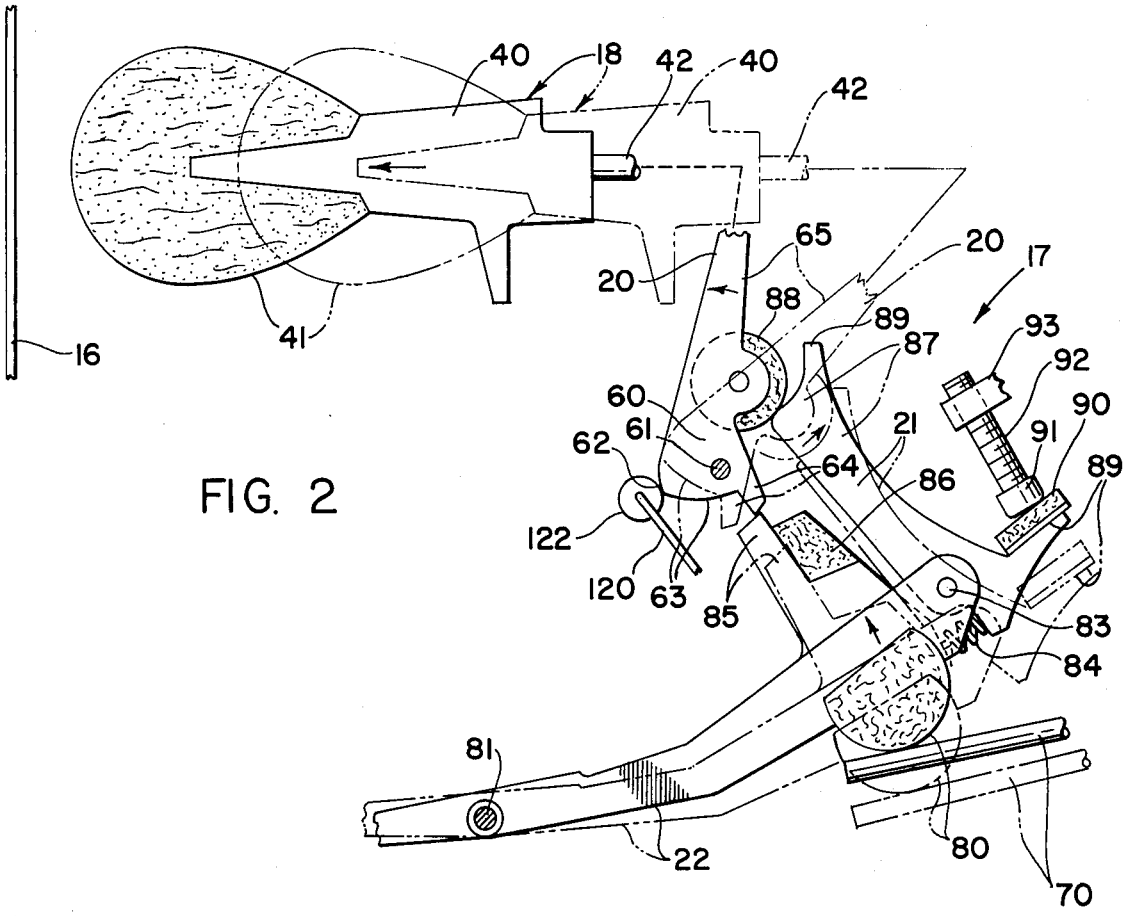
FIGS. 2–4 depict sequentially the novel escapement action of the present invention in various positions in response to depression and release of the key.
Figure 3:
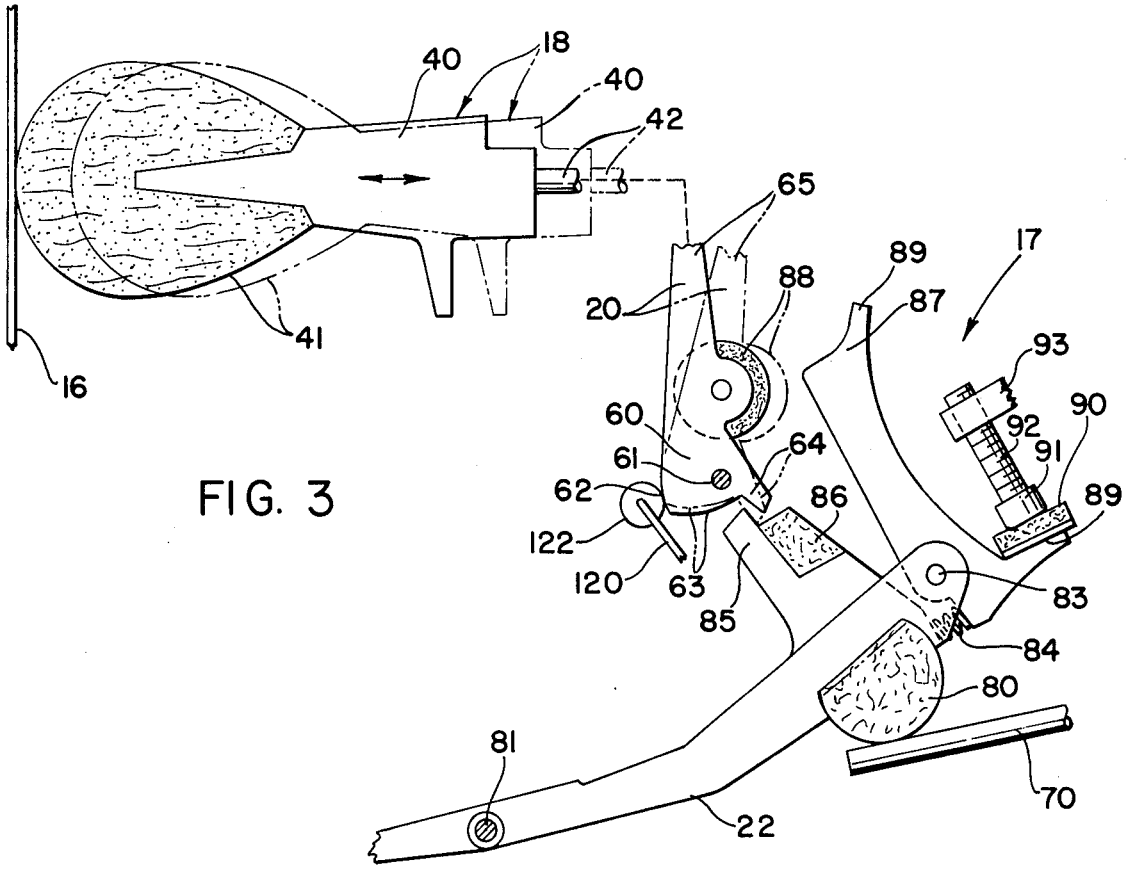
Figure 4:
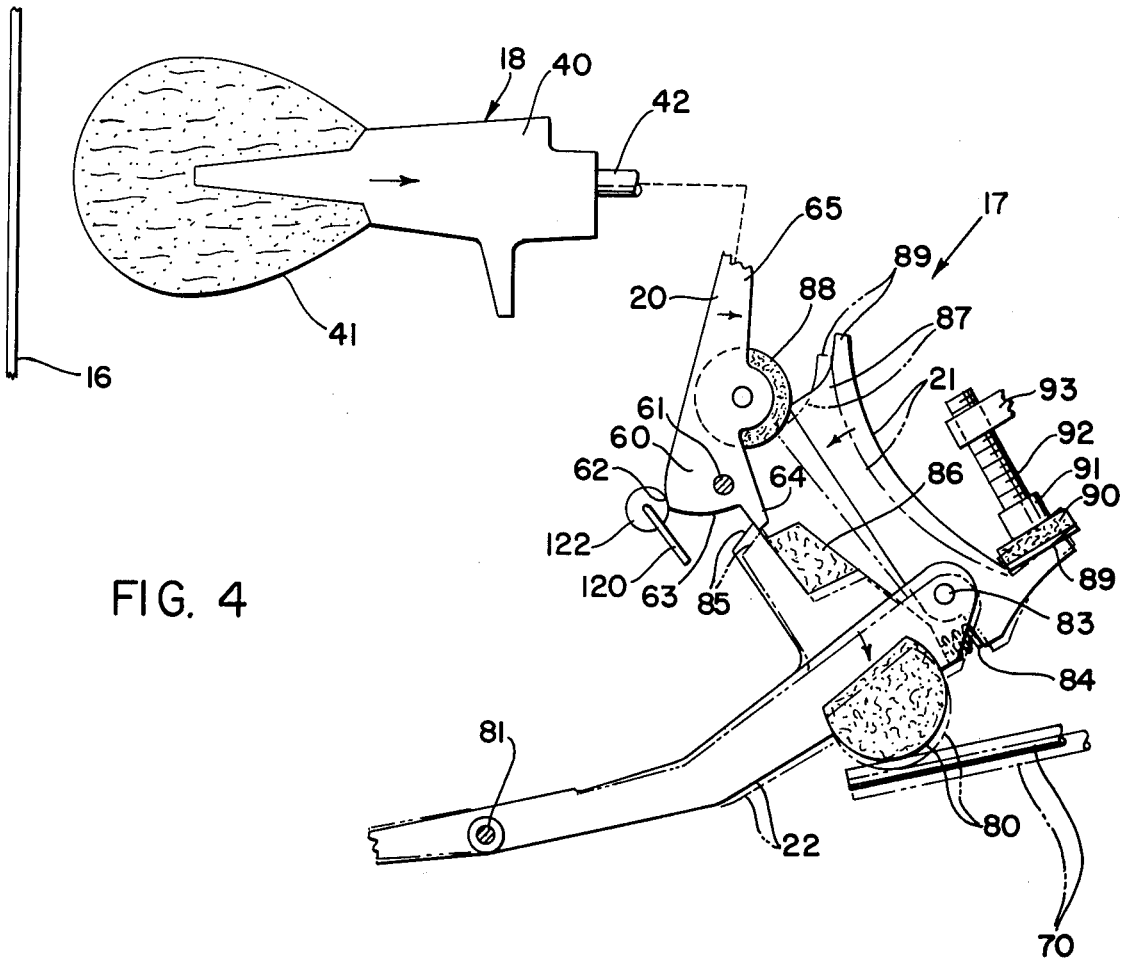

With particular reference now to FIGS. 2–4, operation of the escapement action 17 shall be described. In FIG. 2 the striking mechanism 15 at rest is depicted in phantom. As the lever arm 70 is raised to the solid line position, arm 22, jack 21 and drive link 20 rotate in a counterclockwise direction moving the hammer head 40 toward the string 16. The foot 87 of jack 21 continues to engage and drive the felt cushion 88 of drive link 20 until the jack pad 90 contacts the head of stop screw 91. At this instant, the hammer head 40 has moved to its solid line position.

In FIG. 3, continued depression of the key 24 has raised the lever arm 70 and arm 22 for the jack foot 87 to slip beyond the felt cushion 88, driving the link 20 and hammer covering 41 toward the strings 16 by inertia. Further pivotal movement of the arm 22 is limited by contact of the tang 64 with the cushion 86. It should be remembered, that simultaneously the damper assembly corresponding to the key depressed shall be activated to withdraw the damper head 101 away from the strings 16 contacted by the hammer felt 41. The hammer felt and head, after having struck the strings 16, will immediately rebound away by the action of spring 58, in order to permit the strings to vibrate freely even though the key remains depressed. The amount of rebound, depicted in phantom, is limited by the engagement of drive link tang 64 with the leg 85 of arm 22. The small spring 84 is now compressed and exerts a clockwise rotational force through jack foot 89 against the stop screw 91.

In FIG. 4, as the key 24 is partially released, the lever arm 70 falls allowing the arm 22 to pivot counterclockwise around lug 81. Simultaneously, the jack 21 pivots counterclockwise about pin 83 due to the release of spring 84, although the drive link 20 remains stationary. At the instant the jack foot 88 reaches the position depicted in phantom (also depicted in solid line in FIG. 2) the drive link tang 64 is released by the leg 85 and the key 24 may be depressed again without further release thereof or, if desired, it may be released altogether allowing the mechanism 15 to return to its prestruck position.

With reference again now to FIG. 1, a simplified mechanism for operation of the soft pedal of the piano includes a lever 110 having a pivot point (not shown) below the damper assembly 23. A control rod 111 connected to the conventional pedal linkage drives the lever 110 toward and away from the strings 16. A rod 112 passes through a bore in lever 110, a bore in a tang 113, extending downwardly from hammer head 40, and is connected to an angle bracket 114 by welding or other suitable method. The rod 112 may be supported in a manner not shown such as in a bushing carried by an end support plate 19. A stop 115 is provided at the end of rod 112 adjacent its point of passage through the lever 110. Forward movement of the lever 110 carries the rod 112, angle bracket 114 and all hammer tangs 113 closer toward the strings 16. Given a shorter distance in which to move the hammer head 40, less energy is developed and therefore a sound of less magnitude results. Cushioning materials 116 and 118 may be provided to eliminate direct contact between the bracket 114 with frame 31 and tangs 113, respectively.

Figure 6:
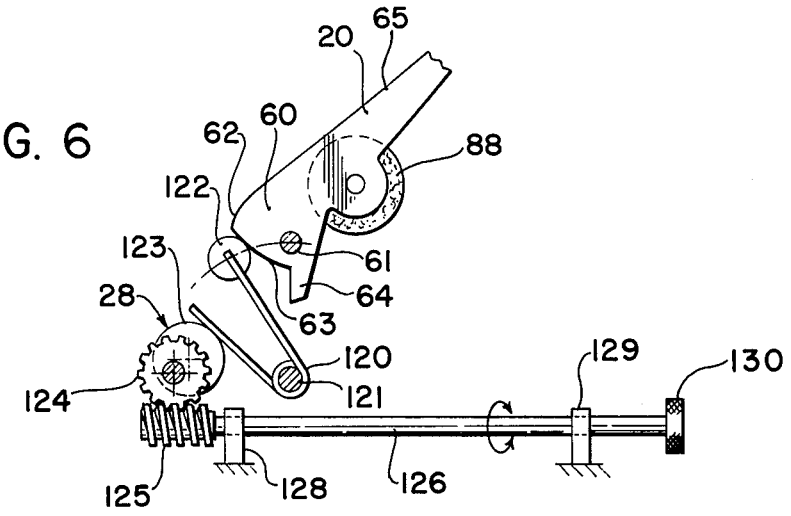
FIGS. 6–8 depict a portion of the striking mechanism featuring a novel mechanism for adjustment of the amount of force necessary to depress a key of the piano.
Figure 7:
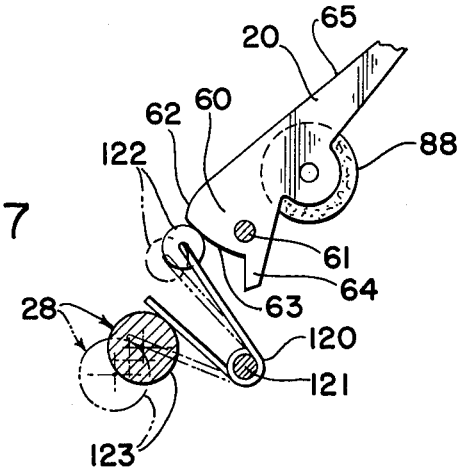
Figure 8:
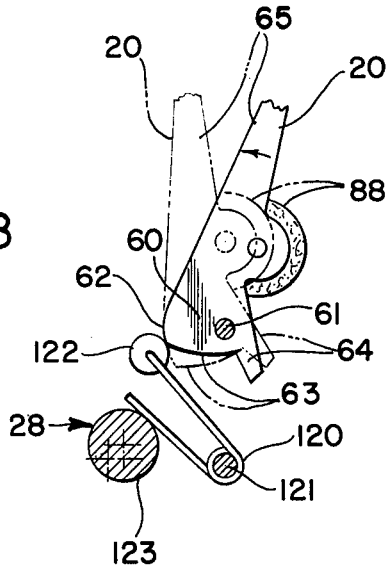

The tension adjustment mechanism 28 can best be described with particular reference to FIGS. 6–8, and includes a wire combination spring 120 held on a lug 121 from plate 19. The upper end of spring 120 carries a small roller 122 which is engageable with the lower cam surface 63 of drive link 20. A cylindrical cam bar 123 is eccentrically mounted to a gear wheel 124 which in turn engages a worm gear 124 extending from a rod 126 supported by brackets such as 128 and 129. Rotation of a knob 130, affixed to the end of rod 126, in one direction causes the cam bar 123 to rotate away from the drive link 20, as depicted in solid in FIG. 7. Eventually, the roller 122 falls away from contact with the cam surface 63 in which instance the drive link 20 is moved by a light or perhaps standard amount of force on a key. Rotation of the knob 130 in the opposite direction compresses the spring between cam bar 123 and cam surface 63, as depicted in phantom in FIG. 7, simultaneously increasing the force necessary to depress a key.

In any position where the roller 122 engages the drive link 20 it is necessary for the cam surface 62 to have a different slope than cam surface 63. Otherwise, an increasing amount of force would need be applied until the hammer felt actually contacted the strings 16, greatly diminishing the expression called for by the pianist and/or the music. Thus, the cam surface 62 allows the roller 122 to remain in contact therewith but eliminates the force of the spring 120 once the jack 21 escapes the drive link 20.

Although the tension adjustment mechanism 28 has been described for operation in conjunction with the drive link 20, it is believed to be within the scope of this invention to provide such a mechanism in operable engagement with other levers of a striking mechanism as may be suitable, such as for instance, the piano key itself.

Figure 5:
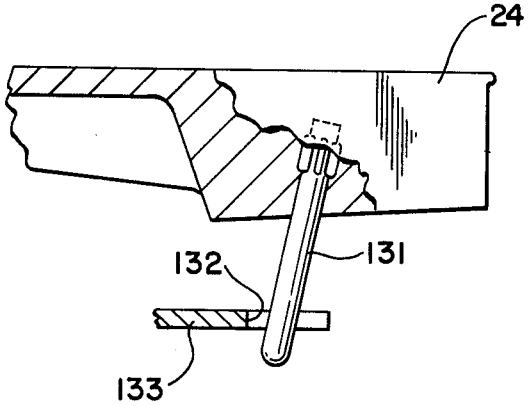
FIG. 5 depicts an improved construction for the front rail of a piano key and its relation to the key frame.

Additional components disclosed herein include a front rail pin 131 permanently embedded within the key 24 (FIG. 5) at the time of manufacture which is thereafter movable within a slot 132 provided in the front rail 133, and the improved balance rail assembly 24 depicted in FIG. 1. The latter improvement comprises a readily removable bracket 134 of plastic or similar material, having a pair of parallel ears 135 and a bottom flange 136 held between brackets 138 and 139, which have a rounded end and mating socket, respectively, which are fastened together with several nuts and bolts such as 140. The brackets 138 and 139 may readily be affixed to the front rail or the inner sides of the piano keyboard area. Pivot pins 141 carried by each key 24, generally parallel with the width of the key and within a channel 142 are readily slipped into a slot 143 provided in each of the ears 135 and permit pivotal movement of the key 24. A curved spring 144 may be employed between the ears 135, as depicted in FIG. 1, to maintain the pivot pin 141 in firm engagement with the slot 143 should the latter become enlarged due to wear.

Figure 9:
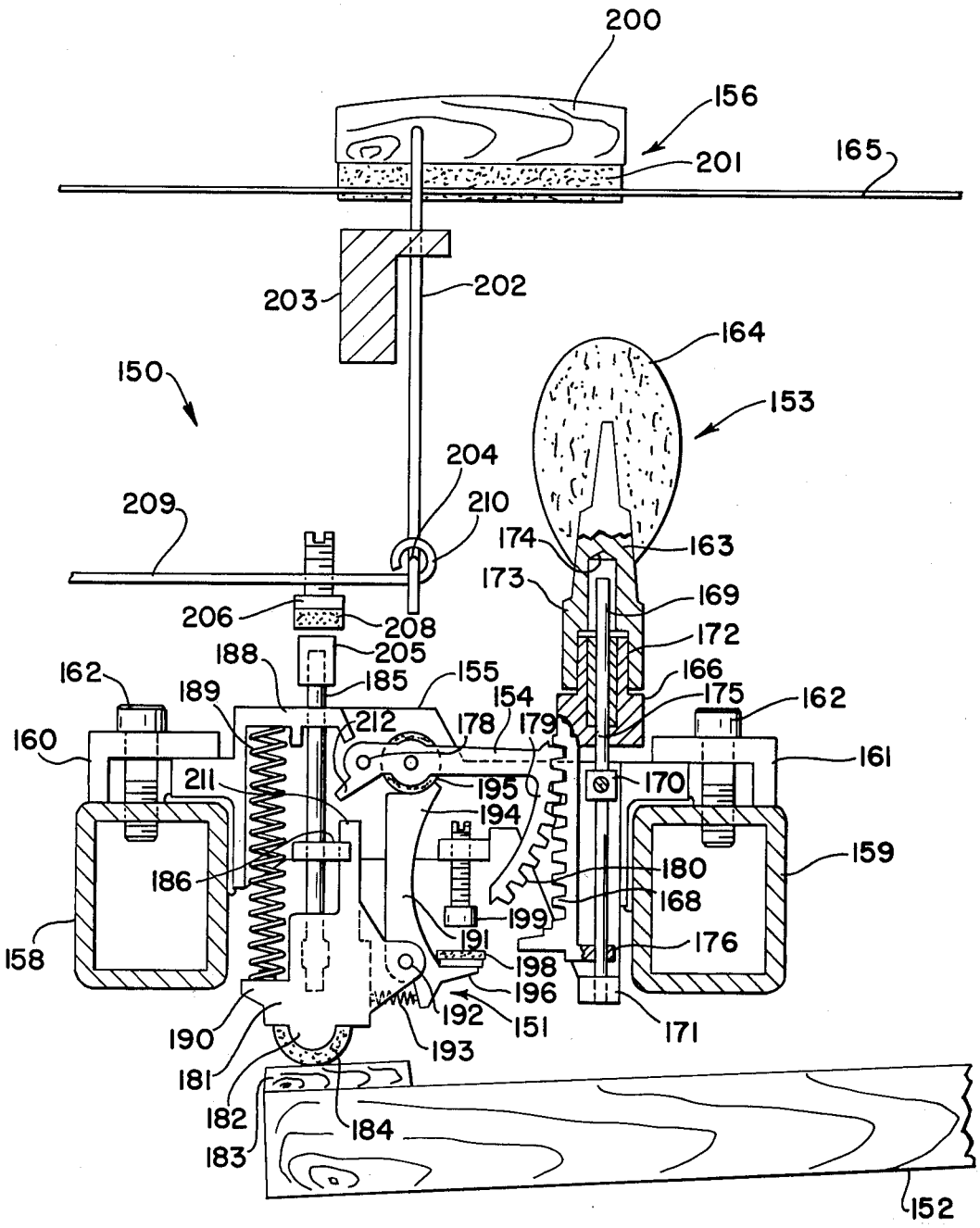
FIG. 9 is a side elevation, partially in section, of a striking mechanism for use in a grand piano and depicting a novel escapement action.

In FIG. 9 a striking mechanism for a grand piano, referred to generally by the numeral 150, is depicted with an escapement action, generally 151 which is similar in principle to the escapement action 17 of the striking mechanism 15. The striking mechanism 150 includes a key 152, hammer assembly, generally 153, drive link 154, support plate 155 and damper assembly, generally 156. The support plate 155 is itself supported by two channels 158 and 159, being secured to each by flanges 160 and 161, respectively, and a plurality of cap screws or bolts 162.

The hammer assembly 153 includes a head 163 with a felt covering 164 for striking a string or strings 165. The hammer butt 166 carries a rack of teeth 168 similar to the hammer butt 43, described in FIG. 1. A hammer guide rod 169 is vertically mounted in support posts 170 and 171 extending from plate 155 so as to remain stationary. The upper end 172 of the butt 166 engages a recess in the base 173 of the hammer head 163. Both the head and the butt may be manufactured from plastic and move as one piece on the guide rod 169, the head 163 having an elongate bore 174 for clearance of the upper end of rod 169, and the butt 166 having a bore 175 for passage of the rod 169. A flange 176 at the lower end of the butt having an aperture aids the alignment of the butt as it travels vertically along the rod 169.

The drive link 154 is pivotally mounted near its base on a lug 178 extending from plate 155 and at its opposite end carries an arcuate drive sector 179 having a plurality of teeth 180 which mesh with rack teeth 168 to drive the hammer butt and head toward the string 165.

The escapement action 151 includes an action arm 181, having a base 182 which engages the tip 183 of the key 152. Felt or other insulation may be applied to either surface such as the pad 184. The arm 181 has a vertically extending rod 185 which is mounted in apertures provided in flanges 186 and 188 extending from plate 155. A compression spring 189 is located between the flange 188 and a foot 190 near the base of action arm 181. Thus, the arm 181 is resiliently biased against the key 152 and when it is activated by depression of the key its movement is guided by the flanges 186 and 188.

Opposite the foot 190, the jack 191 is pivotally mounted by a pin 192 to the action arm 181. A small compression spring 193, held between opposed lugs on arm 181 and jack 191, tends to pivot the jack 191 in a counterclockwise direction around the pin 192. The jack 191 extends generally upwardly away from the pin 192 and terminates in an arcuate foot 194 which engages a circular felt cushion 195 carried by the drive link 154 and by which the link is pivoted. At the lower end of jack 191 is a perpendicularly extending foot 196 having a felt pad 198 which is brought into silent contact with an adjustable stop screw 199 carried by support plate 155.

The damper assembly 156 includes a damper head 200 provided with a felt pad 201 which reposes against the string or strings 165 for each note. A damper wire 202 may be attached to the head 200 in any suitable manner and extends downwardly through a guide bracket 203 and is thereafter bent so as to form a neck 204. A head 205 affixed at the end of the action arm rod 185 is engageable with an adjustable lifter 206, having a felt pad 208. The lifter 206 passes through an aperture in a pivotally mounted lever 209 having an end 210 which communicates with the neck 204 of the damper wire. Upon depression of a key 142, the head 205 contacts and drives the lifter 206 upwardly raising the lever 209, damper wire 202 and damper head 200 from the string 165, allowing it to vibrate freely when struck by the hammer felt 164, until the key is released.

As should be apparent, while the key is being depressed, the action arm 181 raises the jack 191 which commences pivotal movement of the drive link 154.

Once the jack foot 196 contacts the stop screw 199, clockwise rotation of the jack 191 commences around pivot pin 192 which continues to drive the link 154 and hammer butt 166 while the jack 191 ultimately slips away from the felt cushion 195, driving the link and hammer felt 164 toward the strings 165 by inertia. Although not shown sequentially, when the key has been totally depressed and the hammer felt 164 has struck and fallen slightly away from the strings 165, a vertically extending leg 211 from action arm 181 catches a tang 212 extending from drive link 154 thereby prohibiting the return of drive link 154 and hammer butt 166 to their former resting positions. Compression of the jack spring 193 urges the jack 191 to pivot in counterclockwise fashion around the pin 192 so that the jack foot 194 can reposition itself under the felt cushion 195 for a subsequent movement before the depressed key has been totally released.

Figure 10:
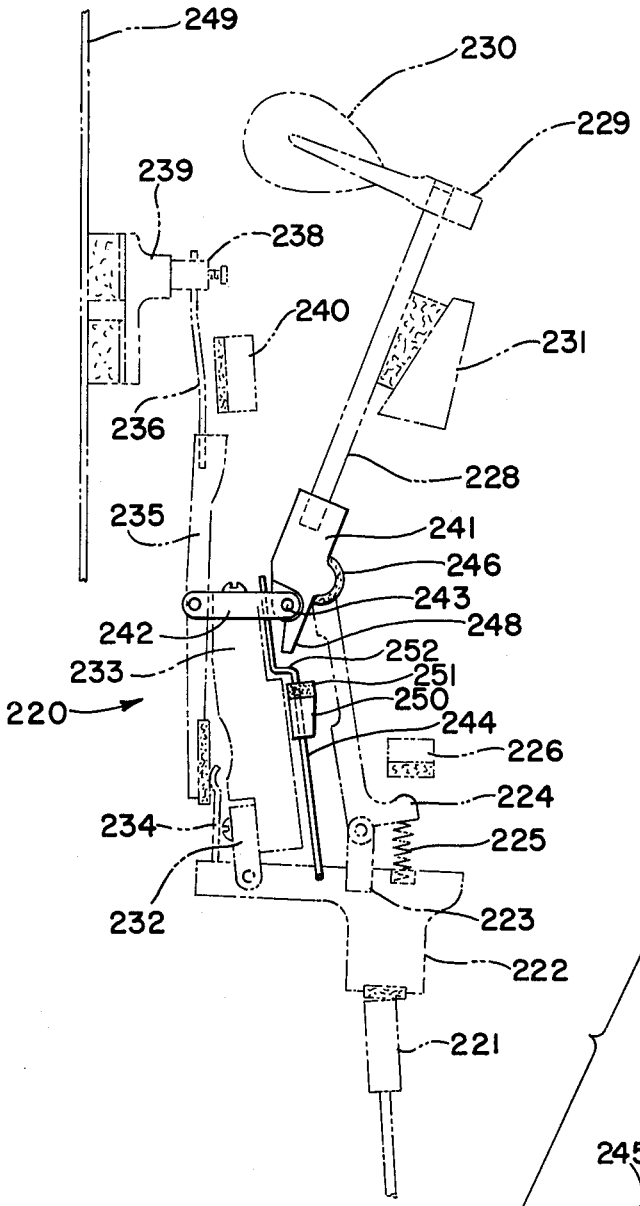
FIG. 10 is a side elevation of a conventional striking mechanism for an upright piano wherein a novel escapement action has been substituted for several of the existing components; and, FIG. 11 is an exploded perspective view, on an enlarged scale, depicting the manner in which the novel escapement action of the present invention is assembled for use with conventional striking mechanisms.

Other features described in conjunction with the striking mechanism 15 depicted in FIG. 1 may readily to employed with the mechanism 150, or with still other conventional striking mechanisms, but have not been repeated here. One last improvement, set forth in FIGS. 10 and 11, relates to a simplified escapement action which has been adapted for use with a conventional, upright piano striking mechanism, indicated generally by the numeral 220.

The mechanism 220 includes a capstan 221, wippen 222, jack flange 223, jack 224, jack spring 225, let-off dowel 226, hammer shank 228, hammer head and covering 229 and 230, hammer rest rail 231, wippen flange 232, action flange rail 233, damper spoon 234, damper lever 235, damper wire 236, damper head 238, damper 239, hammer butt spring rail 240 and several other components not shown for the sake of clarity.

New components which function as a suitable escapement action include a modified hammer butt 241 which is pivotally attached to a modified damper flange 242 via pin 243. Although the damper flange also pivotally mounts the damper lever 235, on a conventional mechanism 220, the existing hammer butt (not shown) would not be pivotally affixed thereto in a coventional mechanism. Also provided as a new element is a catcher wire 244 formed from a stiff, flexible wire having the shape depicted in FIGS. 10 and 11. The catcher wire 244 passes freely through an aperture 245 in damper flange 242 and is embedded in wippen 222 so as to remain stationary therein. A felt pad 246 should be affixed to the butt 241 to silence contact with the jack 224.

Figure 11:
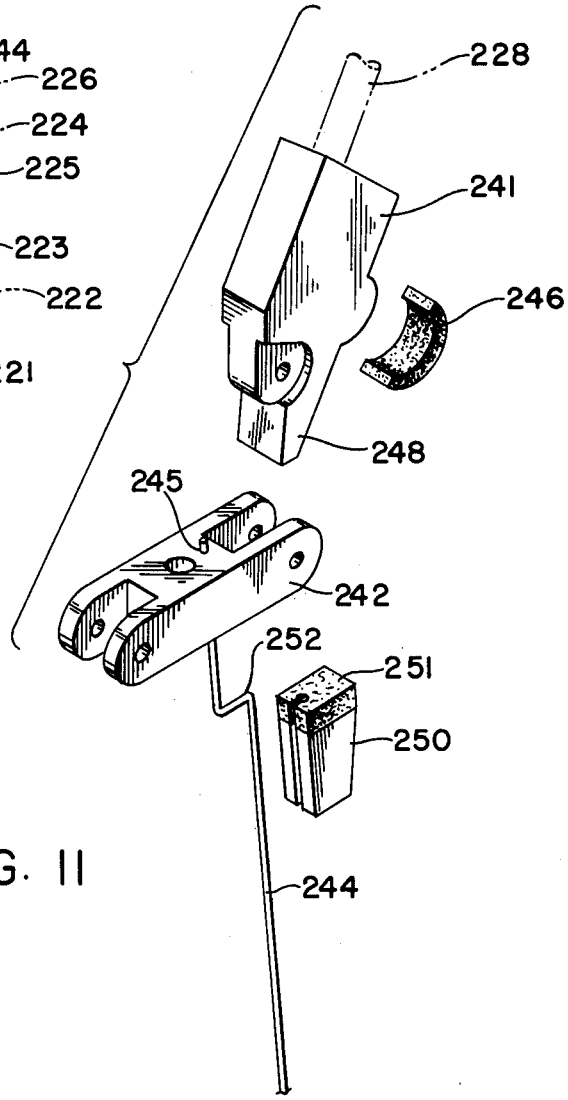

A modification of the hammer butt 241 includes the downwardly extending tang 248 which pivots outwardly away from flange rail 233 as the key is depressed. Whe the key is depressed, raising the wippen 222 and jack 224, the butt 241 is pivoted around pin 243, the jack ultimately slips past the felt pad 245, with compression of the spring 225, and the hammer 230 is driven toward the string 249. Simultaneously, the damper 239 is withdrawn from the string. Also raised with the wippen 222 is the catcher wire 244. A stop 250 provided with a felt cushion 251 and affixed to the wire 244 is also raised and it will engage the tang 248, limiting the extent of upward travel of the wippen 222, in those instances where the key has been struck forcefully. The stop 250 may be manufactured from a suitable resilient plastic and slipped onto the wire 244 as depicted in FIG. 11 or it may be affixed thereto in another suitable manner.

After the string has been struck the hammer falls away until the tang 248 contacts the shoulder 252 of the catcher wire 244 which has been raised with the wippen 222. As the key is substantially being released, the jack 224, driven by spring 225, will be repositioned beneath the felt pad 246, the tang 248 will then escape the shoulder 252, and the key can again be depressed to produce a second note although it had not been totally released after the first note. Simultaneous movements of the mechanism 220 shall not be described inasmuch as they shall remain the same and be apparent to those skilled in the art. It is believed that the improved escapement action set forth herein has been designed not to interfere with these movements but only to simplify escapement.

Thus, it should be apparent from the foregoing description of the preferred embodiments and improvements that the present invention herein described accomplishes the objects of the invention.

What is claimed is:

1. A striking mechanism for use in pianos and related instruments having at least one string to produce a musical note and at least one key to select the musical note comprising:

at least one hammer assembly for striking a string;

an escapement action actuated by said key;

a first lever engageable with said escapement action and said hammer assembly and interposed therebetween;

coacting gear means for imparting motion to said hammer assembly from said first lever; and, means for supporting said hammer assembly, said escapement action and said first lever.

2. A striking mechanism, as set forth in claim 1, wherein said escapement action comprises:

an action arm movable with respect to said means for support and having an upper and lower surface, a portion of said lower surface being in communication with the key and a leg extending from said upper surface;

a jack pivotally carried by said action arm having a first foot at one end engageable with said first lever and a second foot at the other end;

means for biasing said second foot of said jack away from said action arm; and, stop means engageable with said second foot for controlling pivotal movement of said jack with respect to said action arm.

3. A striking mechanism, as set forth in claim 2, wherein said first lever is pivotally carried by said means for support and includes:

an arcuate segment at one end carrying a portion of said coacting gear means; and, a tang at the other end engageable with said leg of said action arm when said second foot of said jack engages said stop means.

4. A striking mechanism, as set forth in claim 1, wherein said hammer assembly comprises:

a hammer head;

a hammer butt mounted on said support plate for linear reciprocal movement with respect thereto, communicating with said first lever, and carrying a portion of said coacting gear means; and, means for guiding movement of said hammer head and hammer butt toward and away from the string.

5. A striking mechanism, as set forth in claim 1, wherein said escapement action includes an action arm movable with respect to said means for support, said striking mechanism further having a damper assembly comprising:

a bar traversing the width of said striking mechanism;

at least one lever pivotally mounted on said bar and communicating with said action arm;

a damper wire carried by said lever;

a damper head carrying a cushion, engageable with at least one string, and having a rod member with an aperture for said damper wire; and, means for maintaining said rod member on said damper wire.

6. A striking mechanism, as set forth in claim 5, wherein said damper assembly further includes:

a rotatable channel member engageable with said levers whereupon rotation of said channel member causes each said lever to pivot simultaneously withdrawing said damper head cushions from said strings.

7. A striking mechanism, as set forth in claim 1, wherein said first lever has a base pivotally carried by said means for support, said striking mechanism further having a tension adjustment mechanism comprising:

a cylindrical member engageable with said base;

biasing means carrying said cylindrical member for applying radial force against said base;

cam means communicating with said biasing means for controlling the amount of force applied by said biasing means; and, means for adjusting said cam means with respect to said biasing means.

8. A striking mechanism, as set forth in claim 1, wherein said hammer assembly carries a tang, said striking mechanism further including:

means for moving said tang and said hammer assembly closer to the string whereby the note produced by the string upon depression of the key will be of less magnitude than when said hammer assembly is farther from the string.

9. A striking mechanism, as set forth in claim 8, wherein said means for moving said tang comprises:

a movable bracket engageable with said tang;

a link rod affixed to said bracket;

a pivotally mounted lever arm connected to said link rod; and, means to pivot said lever arm.

10. A striking mechanism, a set forth in claim 1, wherein the key carries two apertures and said escapement action includes an action arm, said striking mechanism further including a capstan lever assembly comprising:

a lever arm having a neck, one end of said lever arm being received in one of the apertures of the key and the other end of said lever arm communicating with said action arm;

a collar supporting said neck beneath the key; and, means for adjusting the distance between the collar and the key and communicating with the other aperture of the key.

11. A striking mechanism, as set forth in claim 1, wherein each key carries a pin generally parallel to the width of the key and provided within a channel, said striking mechanism further including a balance rail assembly comprising:

a bracket having a bottom flange and a pair of parallel ears, pivotally engaging the pin of the key; and, first and second brackets carried by the piano beneath the keys and mounting each said flange.

12. A striking mechanism, as set forth in claim 1, wherein the piano includes a front rail having a plurality of elongated slots and each key carries a rail pin permanently embedded within the underside of the key and movable longitudinally and vertically within said elongated slot.

13. An escapement action for use with pianos and related instruments having at least one string to produce a musical note, at least one key to select the musical note, a hammer to strike the string and a lever having a drive sector in driving communication with the hammer, said escapement action comprising:

a support member;

an action arm movable with respect to said support member and having an upper and lower surface, a portion of said lower surface being in communication with the key and a leg extending from said upper surface;

a jack pivotally carried by said action arm having a first foot at one end engageable with the lever and a second foot at the other end;

means for biasing said second foot of said jack away from said action arm; and, stop means engageable with said second foot for controlling pivotal movement of said jack with respect to said action arm.

14. An escapement action, as set forth in claim 13, further including:

a tang extending from one end of the lever engageable with said leg of said action arm when said second foot of said jack engages said stop means.

15. A tension adjustment mechanism for use with pianos and related instruments having a plurality of strings to produce musical notes and s striking mechanism for selecting the notes and striking the strings having at least one pivotal lever member, said tension adjustment mechanism comprising:

a cylindrical member engageable with the lever member;

biasing means carrying said cylindrical member for applying force against the lever member;

cam means communicating with said biasing means for controlling the amount of force applied by said biasing means; and, means for adjusting said cam means with respect to said biasing means.

16. An improved striking mechanism for use in pianos and related instruments having a plurality of strings to produce musical notes and a striking mechanism for selecting the notes having a plurality of hammers for striking the strings wherein the improvement comprises:

a tang carried by each said hammer; and, means acting upon said tangs for simultaneously moving a plurality of said tangs and hammer assemblies closer to the strings whereby the notes produced by the strings upon depression of the keys will be of less magnitude than when said hammer assemblies are farther from the strings.

17. A striking mechanism as set forth in claim 16, wherein said means for acting upon and moving said tangs comprise.

a movable bracket engageable with each said tang;

a link rod affixed to said bracket;

a pivotally mounted lever arm connected to said link rod; and, means to pivot said lever arm.

18. An improved capstan lever assembly for use with a piano key to activate a striking mechanism which produces musical notes wherein the improvement comprises:

a piano key having two apertures;

a lever arm having a neck, one end of said lever arm being received in one of the apertures of the key and the other end of said lever arm communicating with the striking mechanism;

a collar supporting said neck beneath the key; and, means for adjusting the distance between said collar and the key and communicating with the other aperture of the key.

19. An escapement action for use with pianos and related instruments having at least one string to produce a musical note, at least one key to select the musical note, a hammer to strike the string and a lever in driving communication with the hammer, said escapement action comprising:

a support member;

an action arm movable with respect to said support member and having an upper and lower surface, a portion of said lower surface being in communication with the key and a leg extending from said upper surface;

a jack pivotally carried by said action arm having a first foot at one end engageable with the lever and a second foot at the other end;

means for biasing said second foot of said jack away from said action arm;

stop means engageable with said second foot for controlling pivotal movement of said jack with respect to said action arm; and, a tang extending from one end of the lever engagable with said leg of said action arm when said second foot of said jack engages said stop means.

* * * * *

UNITED STATES PATENT OFFICE
CERTIFICATE OF CORRECTION

PATENT NO. : 4,061,067

DATED : December 6, 1977

INVENTOR(S) : Jorge L. Carbone

It is certified that error appears in the above-identified patent and that said Letters Patent are hereby corrected as shown below:

Col. 7, line 46, "24" should read --25--.

Col. 9, line 21, "to" should read --be--.

Col. 10, line 2, "substantially" should read --subsequently--.

Col. 11, line 43, "a" should read --as--.

Col. 12, line 30, after the word "and", "s" should read --a--.

Signed and Sealed this

*Twenty-second* Day of *August 1978*

[SEAL]

*Attest:*

RUTH C. MASON
*Attesting Officer*

DONALD W. BANNER
*Commissioner of Patents and Trademarks*